US007047944B2

(12) United States Patent
Toth

(10) Patent No.: US 7,047,944 B2
(45) Date of Patent: May 23, 2006

(54) METHOD AND SYSTEM TO DETERMINE ENGINE RESTART

(75) Inventor: Ron Toth, Huntington Beach, CA (US)

(73) Assignee: Toyota Technical Center USA, Inc., Ann Arbor, MI (US)

( * ) Notice: Subject to any disclaimer, the term of this patent is extended or adjusted under 35 U.S.C. 154(b) by 197 days.

(21) Appl. No.: 10/687,902

(22) Filed: Oct. 17, 2003

(65) Prior Publication Data

US 2005/0081828 A1 Apr. 21, 2005

(51) Int. Cl.
*F02D 41/06* (2006.01)

(52) U.S. Cl. ..... 123/491; 123/685; 123/697; 701/103; 701/109; 701/113

(58) Field of Classification Search ..... 123/491, 123/685, 480, 697; 701/103, 104, 113
See application file for complete search history.

(56) References Cited

U.S. PATENT DOCUMENTS 4,735,184 A * 4/1988 Kasanami et al. ..... 123/491
4,889,101 A * 12/1989 Schifferl ..... 123/494
5,394,857 A * 3/1995 Yamakawa ..... 123/686
5,928,303 A * 7/1999 Sakai ..... 701/109
5,934,259 A 8/1999 Onishi ..... 123/491
6,541,741 B1 * 4/2003 Ikeda ..... 219/492
6,819,988 B1 * 11/2004 Dietz et al. ..... 701/29

FOREIGN PATENT DOCUMENTS

JP 6-241092 * 8/1994
JP 9-177578 7/1997
JP 10-239269 * 9/1998
JP 200-235014 * 8/2000

* cited by examiner

*Primary Examiner*—Hai Huynh
(74) *Attorney, Agent, or Firm*—Gifford, Krass, Groh, Sprinkle, Anderson & Citkowski, PC

(57) ABSTRACT

The present invention provides a method for computer controlled fuel injection into a vehicle engine under conditions where the vehicle is starting from cold or being restarted after a short period of being shut off. The method utilizes the value of conductance measured at an air/fuel sensor heater and t least one other engine parameter to determine the correct amount of fuel to be injected into the engine to accomplish efficient combustion. The computer controller adjusts the amount of fuel to be delivered from the fuel injector into the engine based on the value of conductance.

10 Claims, 1 Drawing Sheet

METHOD AND SYSTEM TO DETERMINE ENGINE RESTART

FIELD OF THE INVENTION

The present invention relates to controlling a fuel injector associated with an internal combustion engine and more particularly to a system and method for controlling a fuel injector to inject an appropriate amount of fuel into the internal combustion engine after determining whether the engine is starting from cold or if the engine is restarting after a short shutoff period.

BACKGROUND OF THE INVENTION

Upon starting an internal combustion engine, several factors are frequently used to determine the correct fuel amount for accomplishing efficient combustion in the engine.

Temperature-related factors that most commonly influence the fuel amount required for efficient combustion include temperature of fuel, temperature of the air and engine components in the injection path, and temperature inside the combustion chamber. Whereas these temperature-related factors are not usually measured, intake air temperature and engine coolant temperature are measured and assumed to be closely related to the above items when the engine is running.

In a case where an engine has been shut off for a substantial period of time, temperatures within the engine attain equilibrium. For cases where the engine is restarted after being shut off for a fairly short period of time, temperature equilibrium is assumed not to have been attained. In such case, determination of a correct amount of fuel for injection into the engine for efficient combustion is difficult.

Attempts to use intake air temperature and engine coolant temperature to estimate fuel requirements can cause too much fuel to be estimated for delivery into the engine by the injector. This is because the localized temperatures in the fuel injection region and in the combustion chamber are typically higher than the engine coolant temperature following situations where the engine has only been shut off for a short period of time.

Methods currently exist that use combinations of factors to increase the accuracy of estimating the amount of fuel to be delivered to the internal combustion engine. These factors illustratively include engine running time, engine off time, last coolant temperature before engine shut down, and coolant temperature at starting of the engine. Using combinations of these factors, it is possible to determine if an engine is being started after a long or short period of soaking. However, it is appreciated that such methods require the use of special purpose sensors or transducers which adds time and cost to vehicle development and under some circumstances have are unable to deliver the most efficient amount of fuel to the engine.

The present invention proposes a method that utilizes the air/fuel ratio sensor heater conductance in conjunction with measured engine parameters to determine when an engine has been shut off for a short period of time thus allowing for the vehicle control system to estimate the correct amount of fuel to be delivered to the engine to accomplish efficient combustion.

SUMMARY OF THE INVENTION

The present invention provides a system and method of determining the correct amount of fuel to be injected into an engine for accomplishing efficient combustion after the engine has been subjected to a long or short shut-off period.

The method comprises the steps of providing a computer controller for controlling the delivery of fuel into the engine via a fuel injection system wherein the fuel injection system is in communication with a combustion chamber of the engine.

Thereafter, the process continues by providing at least one air/fuel sensor heater in communication with the computer controller. It is appreciated that in the preferred embodiment of the present invention the at least one air/fuel sensor heater is provided as standard equipment to the engine such that special purpose sensing devices are not required for the present method.

Next, the computer controller is used to determine a value of conductance at the at least one air/fuel sensor heater whereby the computer controller can thereafter use the conductance in conjunction with other measured parameters, such as engine coolant temperature and intake air temperature, to determine the amount of fuel that should be delivered to the engine to accomplish the most efficient combustion. The final step in the process involves using the computer controller to cause the fuel injection system to deliver the correct amount of fuel to the engine relative to the engine shut-off period.

BRIEF DESCRIPTION OF THE DRAWINGS

A better understanding of the present invention will be had upon reference to the following detailed description when read in conjunction with the accompanying drawings in which like parts are given like reference numerals and wherein.

DETAILED DESCRIPTION OF THE INVENTION

Figure 3:
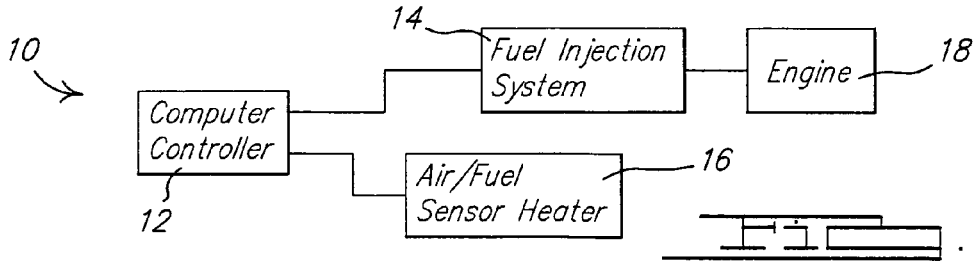
FIG. 3 illustrates a block diagram of the system for determining engine restart.

The present invention provides a method and system for determining a correct amount of fuel that should be delivered to an engine to accomplish efficient combustion wherein the engine has been shut off for either a short or long period of time. FIG. 3 illustrates a block diagram of the essential components of the system for determining engine restart 10 as according to the invention comprising a computer controller 12, a fuel injection system 14, an air/fuel sensor heater 16, and engine 18.

The present invention obviates the necessity of having additional temperature sensors added to the vehicle to determine fuel injection requirements such that efficient combustion is accomplished in an engine 18. In addition to other parameters commonly used to determine the amount of restart fuel, the present method utilizes the conductance value of an air/fuel ratio sensor heater 16 for more precisely determining the amount of restart fuel required after an engine 18 has been shut off for either a short or long period of time. The air/fuel sensor heater 16 impedance is already calculated by the computer controller 12 for a different purpose, so no additional hardware is required to obtain the heater conductance.

The inventive method comprises a first step of providing a computer controller 12 for controlling the delivery of fuel into the engine from a fuel injection system 14. It is appreciated that at least one of many types of computer controllers 12 are provided as standard equipment in a vehicle to control vehicle operation and performance and, more particularly, engine performance. As such, the present invention may be implemented by using the standard equipment provided in most conventional vehicles.

The next step includes providing at least one air/fuel sensor heater 16 in communication with the computer controller 12. At engine startup, the computer controller 12 controls the heater 16 to help warm the air/fuel sensors to a desired operating temperature. When exhaust gas flow is minimal, the heater 16 keeps the air/fuel sensors from cooling down below an optimum operating temperature range. Maintaining the sensor at its optimum operating temperature improves the accuracy and reliability of air/fuel ratio values obtained therefrom which are essential for controlling vehicle emissions.

The process continues by using a computer controller 12 to determine a value of conductance of the air/fuel sensor heater 16. The controller 12 measures the air/fuel sensor heater conductance and controls power to the heater 16 in order to keep the conductance within a proper operating range. This conductance increases after engine start until it reaches the correct level and then is controlled around that point. Preferably, the conductance value is used in conjunction with engine coolant temperature and intake air temperature to determine short periods of engine shutoff such that a correct amount of fuel is delivered from the fuel injector. At engine shut down, the conductance decreases as the sensor cools. Accordingly, the conductance value right before starting can be used to determine if the engine 18 has been recently operated.

After determining the value of conductance of the air/fuel sensor heater 16, the computer controller 12 utilizes this value in conjunction with restart fuel parameters, to more accurately determine the amount of fuel that should be delivered to the engine 18. Restart fuel parameters may include engine coolant temperature, intake air temperature, engine running time, engine off time, last coolant temperature before engine shut down, and coolant temperature at starting of the engine.

Illustratively, the correct amount of fuel required may be determined via a pre-determined look up table or from historical data learned during vehicle operation and stored in the computer controller. Finally, the computer controller 12 operates to control the fuel injection system 14 to deliver the determined amount of fuel to the engine 18 to accomplish efficient combustion.

The above step of using the computer controller 12 to determine the value of conductance may be accomplished by direct measurement at the air/fuel sensor heater 16 or using software to calculate the value of conductance from measuring a value of voltage and/or current.

Figure 1:
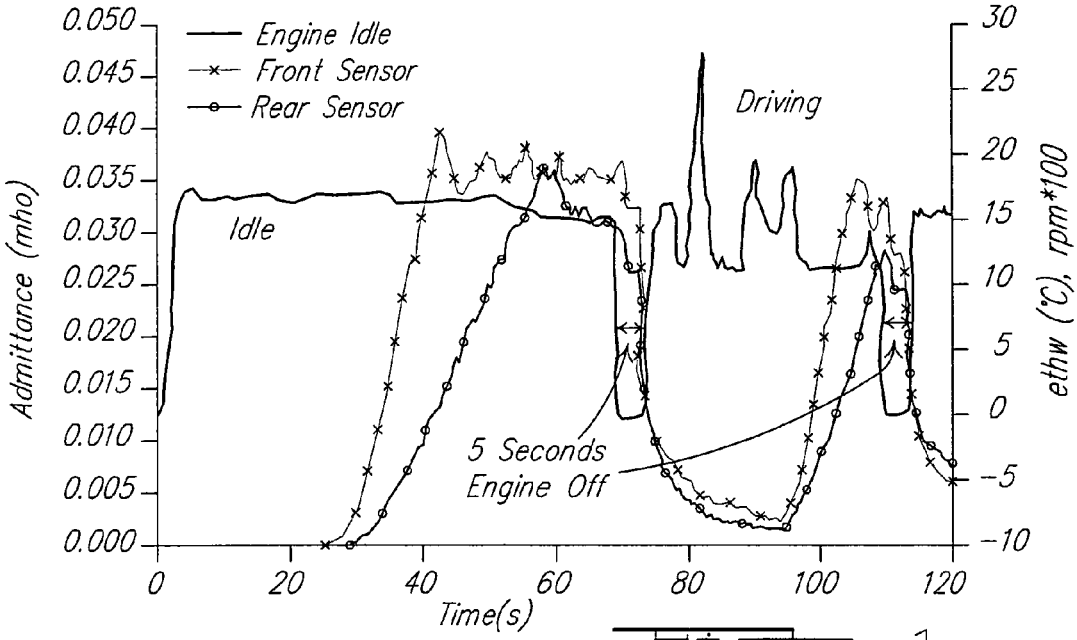
FIG. 1 illustrates a line graph of air/fuel sensor heater conductance during engine warm up from −7.5° Celsius and wherein the engine was twice switched off for a period of five seconds.
Figure 2:
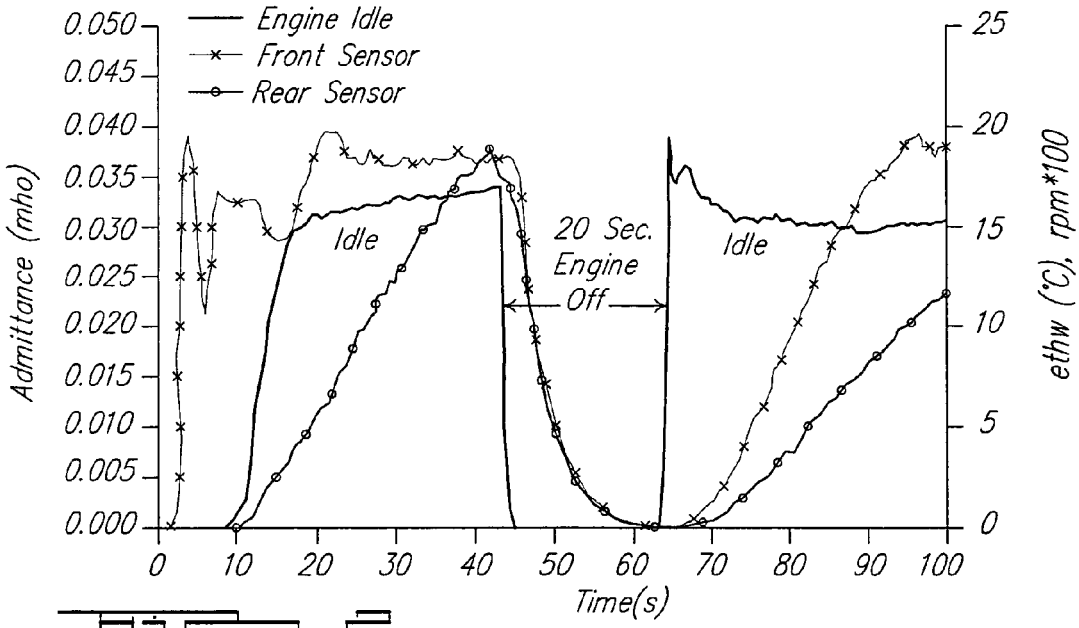
FIG. 2 illustrates air/fuel sensor heater conductance during the engine warming up from 0° Celsius and wherein the engine was shut off for a period of twenty seconds during the measurement.

With reference to FIGS. 1 and 2, it can be determined that the value of conductance at the air/fuel sensor heater 16 decreases as the engine shut-off period increases. FIG. 1 illustrates air/fuel heater conductance during warm up from −7.5° Celsius wherein after the engine 18 had been shut off for a period of approximately five seconds the conductance at the air/fuel sensor heater 16 decreased to approximately 13 milli-mhos. Referring now to FIG. 2, there is illustrated the air/fuel heater conductance during warm up from 0° Celsius and wherein after the engine 18 had been shut off for approximately twenty seconds, the conductance at the air/fuel sensor heater 16 decreased to below zero. This indicates that the air/fuel sensor heater 16 exhibits increasing impedance as the period of engine shutoff increases.

The foregoing description and figures are provided as illustrative of a method for determining engine restart fuel requirements wherein efficient combustion can be accomplished. It is understood that various changes to the core steps and components of the process may be resorted to without departing from the spirit of the invention or the scope of the claims as presented.

What is claimed is:

1. A method for controlling an amount of fuel delivered to an engine upon start in a vehicle, said method including the steps of:

measuring a conductance of an air/fuel sensor heater;

sensing an engine operating parameter using a sensing means;

using the measured conductance of the air/fuel sensor heater and sensed engine operating parameter to determine a length of time the engine was shut off, by a controller operatively in communication with the air/fuel sensor heater and the engine parameter sensing means;

using the length of time the engine was shut off in determining a corrected amount of fuel to be delivered to the engine by a fuel injection system; and delivering the corrected amount of fuel to the engine when the engine starts up.

2. The method of claim 1 wherein said step of determining the value of conductance further includes the step of using the controller to calculate conductance from measured impedance values of the air/fuel sensor heater.

3. The method of claim 1 wherein the value of conductance decreases as the length of time the engine was shut off increases.

4. The method of claim 1 wherein the engine operating parameter is engine coolant temperature.

5. The method of claim 1 wherein the engine operating parameter is intake air temperature.

6. A method for controlling an amount of fuel delivered to an engine upon start in a vehicle, said method including the steps of:

measuring a conductance of an air/fuel sensor heater;

sensing an engine operating parameter using a sensing means;

using the measured conductance of the air/fuel sensor heater and sensed engine operating parameter to determine a length of time the engine was shut off, by a controller operatively in communication with the air/fuel sensor heater and the engine parameter sensing means, wherein the conductance decreases as the length of time the engine was shut off increases;

using the length of time the engine was shut off in determining a corrected amount of fuel to be delivered to the engine by a fuel injection system; and delivering the corrected amount of fuel to the engine when the engine is started.

7. The method of claim 6 wherein the step of determining the value of conductance further includes the step of using the controller to calculate conductance from measured impedance values of the air/fuel sensor heater.

8. The method of claim 6 wherein the engine operating parameter is engine coolant temperature.

9. The method of claim 6 wherein the engine operating parameter is intake air temperature.

10. A system for controlling an amount of fuel to be delivered to an engine at restart, said system comprising:

an air/fuel sensor heater having a conductance;

an engine parameter sensing means;

a fuel injection system; and a computer controller operatively in communication with said fuel injection system and said air/fuel sensor heater, wherein on an engine start said computer controller uses the value of conductance of said air/fuel sensor heater and the input from said engine parameter sensing means to determine how long the engine was shut off and corrects the amount of fuel delivered by the fuel injection system using how long the engine was shut off.

* * * * *